US007757755B2

(12) United States Patent
Kenison et al.

(10) Patent No.: US 7,757,755 B2
(45) Date of Patent: Jul. 20, 2010

(54) SYSTEM AND METHOD FOR MEASURING AN ORIENTATION OF A DOWNHOLE TOOL

(75) Inventors: Michael H. Kenison, Richmond, TX (US); L. Michael McKee, Friendswood, TX (US); Robert Bucher, Houston, TX (US); David P. Smith, Anchorage, AK (US); Sarmad Adnan, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 118 days.

(21) Appl. No.: 11/866,021

(22) Filed: Oct. 2, 2007

(65) Prior Publication Data

US 2009/0084536 A1 Apr. 2, 2009

(51) Int. Cl.
*E21B 47/09* (2006.01)

(52) U.S. Cl. ..... 166/66; 166/255.2; 166/66.5

(58) Field of Classification Search ... 166/255.1–255.2, 166/61, 62, 50; 175/45; 73/152.54
See application file for complete search history.

(56) References Cited

U.S. PATENT DOCUMENTS

| | | | | |
|---|---|---|---|---|
| 4,495,646 | A * | 1/1985 | Gharachorloo | 382/188 |
| 5,064,006 | A | 11/1991 | Waters | |
| 5,230,387 | A | 7/1993 | Waters | |
| 5,275,040 | A | 1/1994 | Codazzi | |
| 5,617,926 | A * | 4/1997 | Eddison et al. | 175/61 |
| 6,173,773 | B1 | 1/2001 | Almaguer | |
| 6,880,634 | B2 | 4/2005 | Gardner | |
| 7,104,331 | B2 * | 9/2006 | Bussear et al. | 166/373 |
| 7,270,178 | B2 * | 9/2007 | Selph | 166/105.5 |
| 2008/0164025 | A1 * | 7/2008 | Peter | 166/255.2 |

* cited by examiner

*Primary Examiner*—David J Bagnell
*Assistant Examiner*—James G Sayre
(74) *Attorney, Agent, or Firm*—Rodney Warfford; Michael L. Flynn; Robin Nava

(57) ABSTRACT

A technique provides an orientation system combined with downhole equipment used in a well. An orientation device is mounted in the downhole equipment, e.g. a bottom hole assembly, for actuation during angular displacement of the downhole equipment. A sensor is mounted to cooperate with the orientation device in detecting the angular displacement.

21 Claims, 6 Drawing Sheets

SYSTEM AND METHOD FOR MEASURING AN ORIENTATION OF A DOWNHOLE TOOL

BACKGROUND

In a variety of downhole applications, the orientation of well equipment deployed in a wellbore can affect the functionality of the equipment. One such application is coiled tubing drilling which is used in many areas as an efficient method of sidetracking or adding lateral wellbores in existing wells. To drill the lateral or side track, the drilling bottom hole assembly must be "kicked out" of the main wellbore. Conventionally, the kick out has been accomplished with an anchor and whipstock. The whipstock must be oriented so the drilling bottom hole assembly is moved in the desired direction. If the well has a deviation less than fifty degrees, wireline has been used to set the anchor and whipstock using an inclination and azmith tool for correct orientation. However, when the deviation is greater than fifty degrees, coiled tubing is used to set the anchor and whipstock.

To correctly orient the whipstock on coiled tubing, one method employs a modified e-line drilling bottom hole assembly and a coiled tubing drilling rig. Another method is to use a memory tool on standard coiled tubing. However, these methods are not very efficient and can be inaccurate. For example, employing a coiled tubing drilling rig in this type of operation requires operation of the rig at a drilling efficiency substantially less than that for which it was designed in drilling wells. Use of the memory tool on standard coiled tubing also is problematic because this approach requires two trips into the well. Additionally, the latter approach requires moving the coiled tubing into the well on the second trip in exactly the same manner as on the first trip downhole. Such repeatability is difficult because coiled tubing tends to move into the well in a corkscrew type pattern difficult to replicate.

SUMMARY

In general, the present invention provides a system and method by which downhole equipment, such a bottom hole assembly, can be oriented in a well. An orientation device is mounted with the downhole equipment in a manner that enables accurate determination of angular displacement in the downhole equipment. A sensor cooperates with an orientation device to determine the angular displacement of the downhole equipment.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for orienting well equipment in a wellbore. For example, the system and methodology can be used to determine the orientation of a bottom hole assembly in a highly deviated wellbore. By way of specific example, the system can be used to determine the orientation of a whipstock and to aid in efficiently setting the whipstock.

In one embodiment, the orientation technique is used to orient a bottom hole assembly with respect to gravity. In this embodiment, an orientation device and sensor can be positioned in the bottom hole assembly to detect angular displacement of the bottom hole assembly relative to a normal or predetermined orientation. In some applications, the orientation system comprises a sensor and an eccentrically weighted orientation device that always orients itself via gravity. The eccentrically weighted orientation device is pivotably mounted inside a portion of the bottom hole assembly in a manner that allows it to rotate independently of the bottom hole assembly. The sensor is used to determine the angular displacement, i.e. rotation, of the bottom hole assembly relative to the eccentrically weighted orientation device and thus relative to the downward orientation of gravitational pull.

Figure 1:
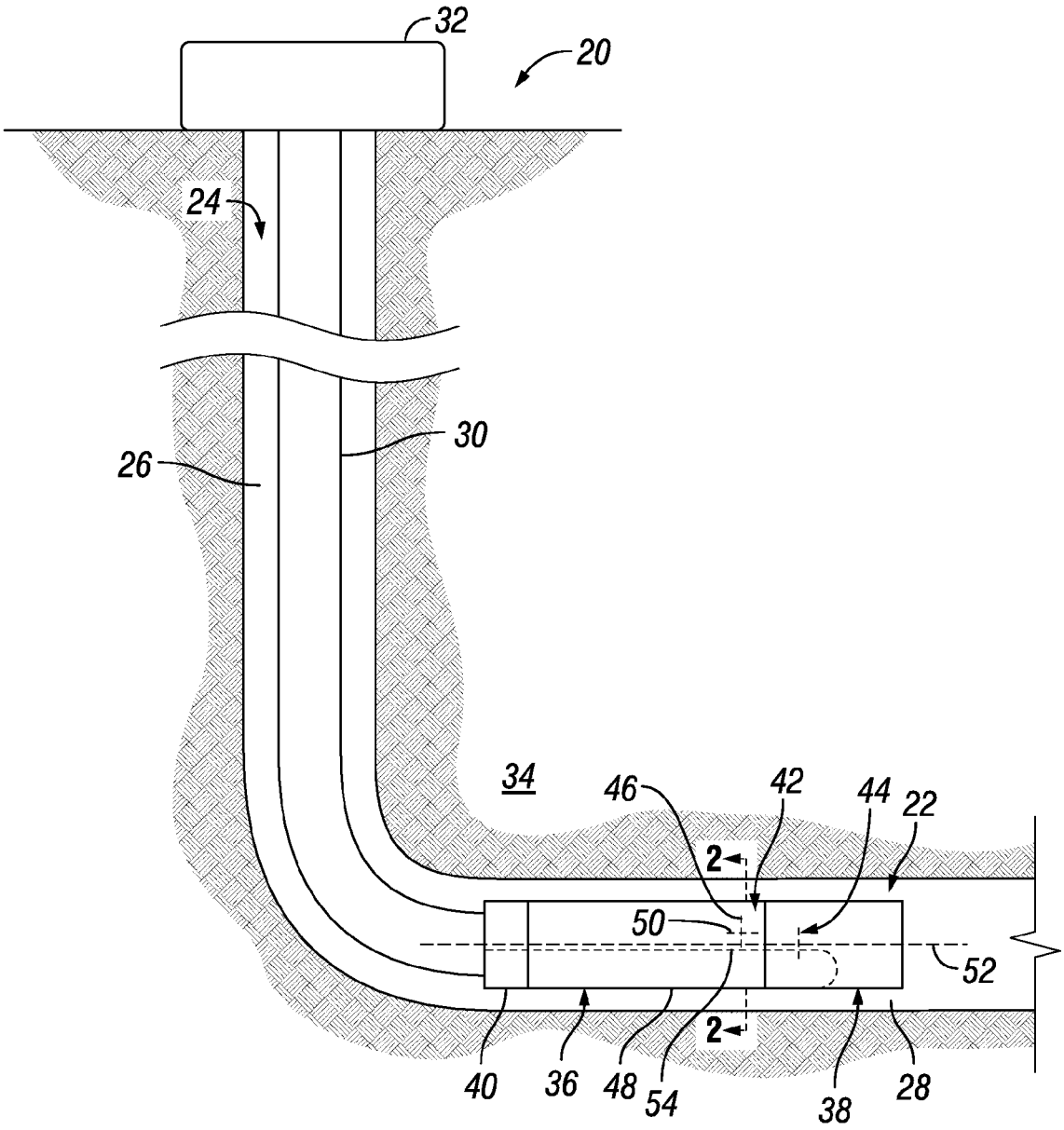
FIG. 1 is a front elevation view of a well system deployed in a wellbore, according to an embodiment of the present invention.

One embodiment of a well system 20 is illustrated in FIG. 1 according to an embodiment of the present invention. In this example, well equipment, e.g. a bottom hole assembly 22, is deployed in a wellbore 24 that may have a vertical section 26 and a deviated, e.g. horizontal, section 28. Bottom hole assembly 22 is deployed into wellbore 24 on a conveyance system 30 which may be tubing, such as production tubing or coiled tubing. In coiled tubing drilling applications, conveyance system 30 comprises coiled tubing used, for example, in drilling laterals, e.g. deviated section 28. Conveyance system 30 is deployed downhole by suitable surface equipment 32 which may comprise a coiled tubing drilling rig or other structures for deploying and using bottom hole assembly 22 in the downhole environment. In a typical application, wellbore 24 is drilled into a formation 34 containing desirable production fluids, such as hydrocarbon based fluids.

Bottom hole assembly 22 may comprise a variety of components and configurations depending on the specific well related application in which it is utilized. In the example illustrated in FIG. 1, bottom hole assembly 22 comprises at least a first portion 36 and a second portion 38 mounted to first portion 36 for rotational movement with respect to first portion 36. In coiled tubing drilling applications, for example, second portion 38 may comprise a whipstock. In some applications, first portion 36 is fixed to conveyance system 30, however other applications benefit from mounting first portion 36 to conveyance system 30 by a directional device 40 able to rotationally orient bottom hole assembly 22 to an orientation desired by an operator.

Well system 20 also comprises an orientation system 42 mounted in the bottom hole assembly 22 to determine the orientation of the assembly. Orientation system 42 can be mounted in, for example, first portion 36 and/or second portion 38 to determine any changes in the rotational orientation of the bottom hole assembly relative to a predetermined orientation. In some embodiments, a second orientation system 44 can be used to determine the rotation of second portion 38 relative to first portion 36. In this latter example, orientation system 42 enables determination of the angular displacement of first portion 36 relative to an original or selected orientation, and second orientation system 44 enables determination of the exact angular position of second portion 38 by providing the additional relative rotational position of second portion 38 with respect to first portion 36.

In the embodiment illustrated in FIG. 1, orientation system 42 comprises an orientation device 46 pivotably mounted within an outer housing 48 of bottom hole assembly 22. The orientation device 46 is mounted for rotational movement about a device axis 50 that is radially offset from a longitudinal, bottom hole assembly axis 52. The orientation device 46 rotates independently of bottom hole assembly 22 and cooperates with a sensor 54 that detects the relative angular displacement between orientation device 46 and bottom hole assembly 22. By way of example, sensor 54 may comprise a fiber optic sensor, although other types of sensors also can be utilized as explained in greater detail below.

Figure 2:
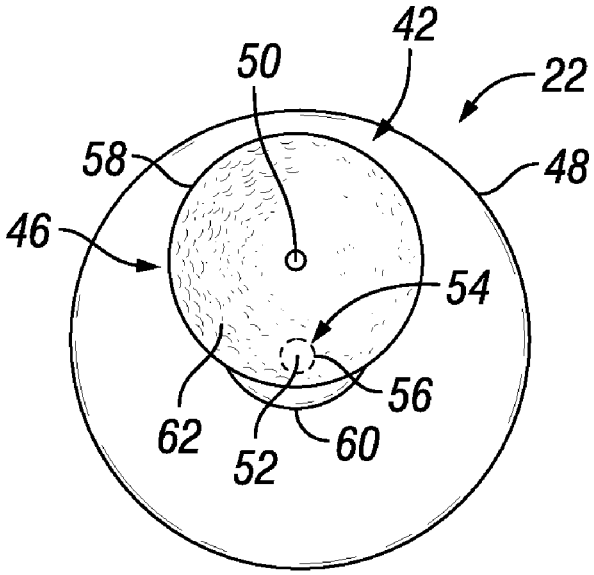
FIG. 2 is a cross-sectional view taken generally along line 2-2 of FIG. 1 showing an orientation device, according to an embodiment of the present invention.
Figure 3:
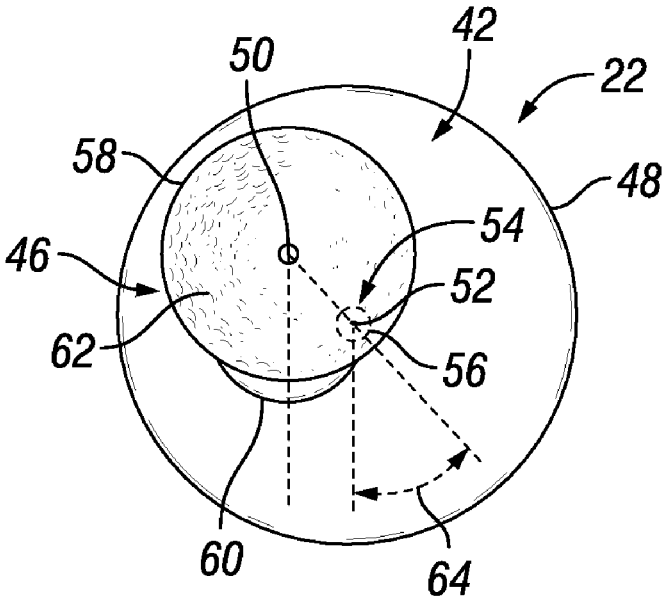
FIG. 3 is a view similar to that of FIG. 2 but showing the well equipment angularly displaced, according to an embodiment of the present invention.

Referring generally to FIG. 2, one embodiment of orientation system 42 is illustrated schematically. In this embodiment, sensor 54 comprises a fiber optic sensor 56 and orientation device 46 comprises a weighted structure 58 having a weight 60 positioned outside device axis 50 to eccentrically weight the structure 58 and thereby maintain a constant rotational position with respect to gravity. This constant rotational position is maintained regardless of the rotation of bottom hole assembly 22 about assembly axis 52. Weighted structure 58 may comprise, for example, a disk having a shaded region 62 that is progressively shaded from light to dark moving along the disk around axis 50. The fiber optic sensor 56 senses the level of shading which corresponds to the degree of angular displacement of bottom hole assembly 22 relative to orientation device 46 and its weighted structure 58, as illustrated in FIG. 3. By way of example, fiber optic sensor 56 may be generally aligned with assembly axis 52 proximate weighted structure 58, and weighted structure 58 may be positioned to rotate through, i.e. intersect, assembly axis 52. This effectively moves sensor 54 along shaded region 62 when bottom hole assembly 22 is angularly displaced relative to weighted structure 58, thus enabling determination of the degree of relative angular displacement.

For example, weighted structure 58 can be shaded so that detection of 100% or 0% light provides an indication that bottom hole assembly 22 is 180° out of a normal or predetermined orientation aligned with the direction of force applied by gravity. Detection of 50% light by sensor 56 indicates the bottom hole assembly 22 is oriented in a normal or predetermined orientation with respect to gravity. Detection of light between these percentages corresponds with specific angular displacements of the bottom hole assembly and provides an indication of the degree to which the bottom hole assembly is misaligned for a specific task, as indicated by angle 64 in FIG. 3. In the embodiment illustrated, a reading between 50% and 100% light indicates the bottom hole assembly is misaligned in a clockwise direction about assembly axis 52, and a reading between 50% and 0% light indicates the bottom hole assembly is misaligned in a counterclockwise direction (see FIG. 3).

The use of fiber optic sensors can be beneficial in a variety of applications. For example, if the sensor is utilized in a rotatable bottom hole assembly, only one fiber is necessary for transmitting information through the rotating joint. By placing the fiber optic sensor 56 and associated optical fiber at a coaxial location with the bottom hole assembly, packaging and assembly of the system is simplified. Additionally, optical fiber is not electrically conductive which obviates the need for certain precautions regarding shorting against metal components. The fiber optic sensor 56 also may not require contact with weighted structure 58 which makes the sensor more resistant to corrosion and less susceptible to other problems sometimes associated with electrical connections. Depending on the application, the measurement capability of fiber optic sensor 56 can be relaxed. If less resolution is needed, for instance, then only a limited number of distinctly shaded regions can be used instead of a continuously variable shaded region 62. A digital method also could be implemented in which distinct lines are detected at fixed increments.

Figure 4:
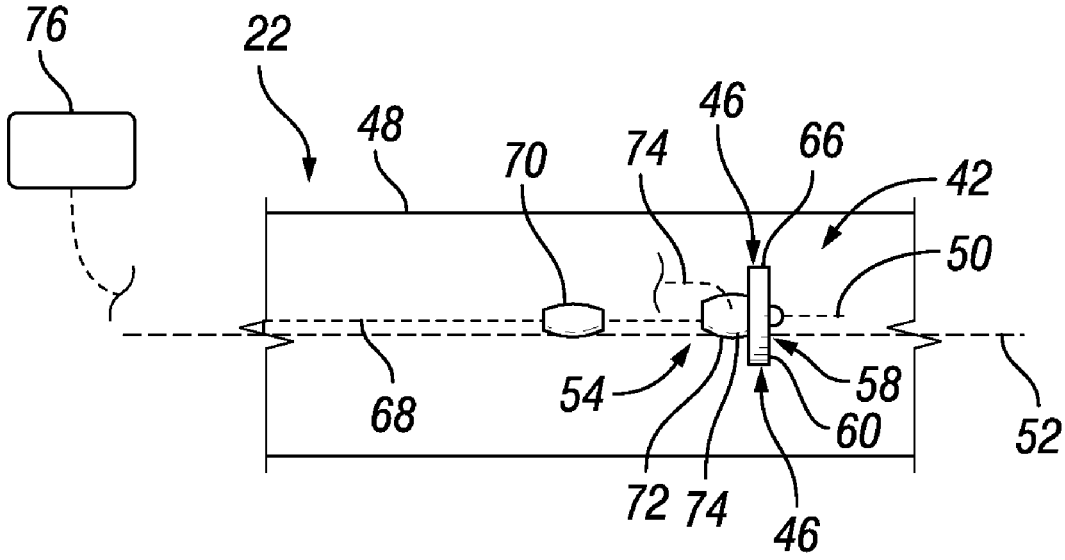
FIG. 4 is a schematic representation of another orientation system, according to an alternate embodiment of the present invention.

However, other orientation devices 46 and other sensors 54 can be utilized in determining the orientation of well equipment, such as bottom hole assembly 22. In the embodiment illustrated in FIG. 4, the disk with shaded region 62 has been replaced with a light polarizing disk 66. In this embodiment, an optical fiber 68 directs a light beam through a fixed polarizer 70. The light beam is then split using a fiber coupler 72, and one of the split fibers directs light through the polarizing disk 66 while the other split fiber 74 bypasses light polarizing disk 66. The resulting light beams can be carried by optical fibers to an appropriate control system 76 positioned, for example, at a surface location. It should be noted that a variety of control systems 76, e.g. computer-based control systems, can be used to determine the angular displacements detected by the variety of sensor systems described herein. Additionally, in some applications, control system 76 can be used in conjunction with directional device 40 to adjust the orientation of bottom hole assembly 22 in response to output from the orientation systems 42 and/or 44.

Figure 5:
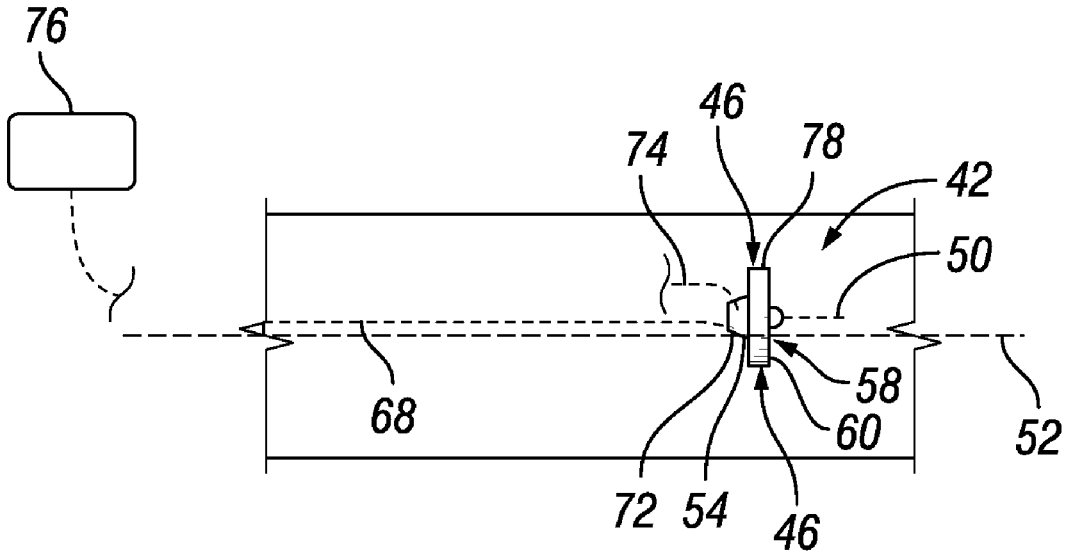
FIG. 5 is a schematic representation of another orientation system, according to an alternate embodiment of the present invention.
Figure 6:
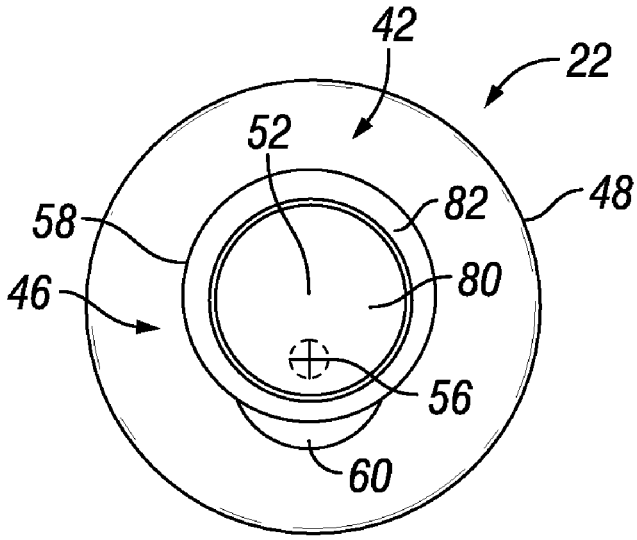
FIG. 6 is a cross-sectional schematic representation of another orientation system, according to an alternate embodiment of the present invention.

Another orientation system 42 is illustrated in FIG. 5. In this embodiment, white light is used and orientation device 46 comprises a transparent disk prism 78. The white light is directed to transparent disk prism 78, and the prism directs light of varying wavelengths (colors) into a receiving fiber and back to controller 76. The wavelength of the light sensed provides an indication of the rotational position of the disk prism 78 relative to bottom hole assembly 22. In another alternate embodiment, the fiber optic sensor 56 is used in cooperation with an orientation device 46 comprising a magnetic flux sensitive polarizing crystal 80, as illustrated in FIG. 6. In this embodiment, the polarizing crystal 80 is fixed with respect to the bottom hole assembly 22, and an eccentrically weighted ring magnet 82 is rotationally mounted about the magnetic flux sensitive polarizing crystal 80. Angular displacement of the bottom hole assembly 22 changes the magnetic field around the polarizing crystal, thus causing the polarizing crystal to polarize light from fiber optic sensor 56 to a different degree. The change in polarization can be detected and the relative angler displacement determined via a control system, such as control system 76.

Figure 7:
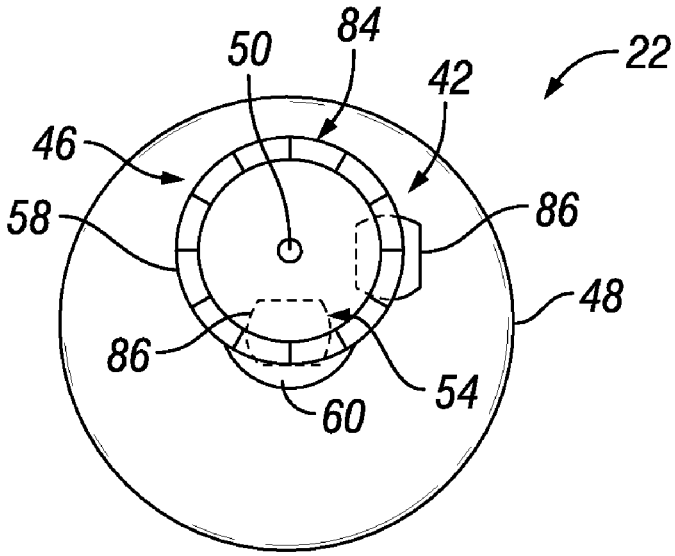
FIG. 7 is a cross-sectional schematic representation of another orientation system, according to an alternate embodiment of the present invention.

In alternative systems, sensors other than fiber optic sensors can be utilized to detect angular displacement. In FIG. 7, for example, the orientation device 46 and sensor 54 cooperate using magnets and hall sensors instead of fiber optic light. In one embodiment, orientation device 46 comprises a magnetic disk 84 having weight 60 to create an eccentrically weighted structure. The rotational position of the magnetic disk 84 is detected by a hall sensor 86 or other suitable sensor. Hall sensor 86 may be mounted generally on assembly axis 52 proximate magnetic disk 84. However, additional or alternate hall sensors 86 can be mounted at other angular positions, as illustrated in FIG. 7, depending on the structure of the bottom hole assembly and the anticipated relative angular displacement. By way of further example, hall sensor 86 may comprise a two axis hall effect sensor used to sense the rotational position of magnetic disk 84.

Figure 8:
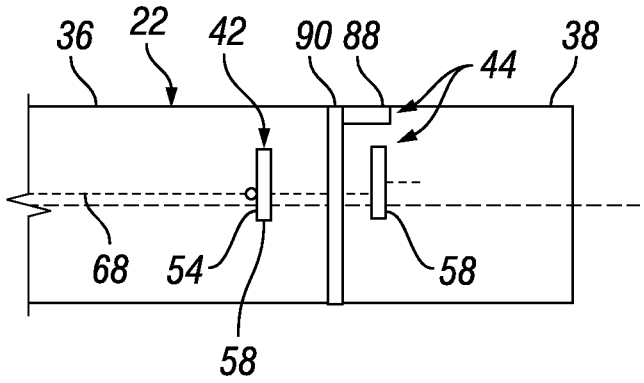
FIG. 8 is a schematic representation of another orientation system designed to measure angular displacement of two separate components of the downhole equipment, according to an alternate embodiment of the present invention.

As discussed with reference to FIG. 1, additional orientation systems can be used to determine the relative orientation of one bottom hole assembly component with respect to another. By way of example, various combinations of the above described orientation devices 46 and sensors 54 can be utilized in determining the angular displacement of first portion 36 and second portion 38. As illustrated schematically in FIG. 8, the first orientation system 42 can utilize weighted structure 58 and sensor 54 to determine the orientation of first portion 36 relative to a gravitational orientation. The second orientation system 44 can be used to determine the orientation of second portion 38 relative to gravity or relative to the position of first portion 36. If second orientation system 44 is used to orient second portion 38 relative to first portion 36, a sensor 88 and an orientation device 90 can be located at a variety of radial positions. For example, sensor 88 can be positioned at a radially outlying position on second portion 38, while orientation device 90, e.g. a magnetic ring, a polarizing crystal, a shaded disk/ring, or other suitable device, is placed in a cooperating position on first portion 36. Alternatively, a second weighted structure 58 can be deployed in second portion 38. Information/data from the weighted structures 58 deployed in first portion 36 and second portion 38 potentially can be transmitted along the same optical fiber 68. The signals from each bottom hole assembly portion can be detected separately at a controller 76 located, for example, at a surface location. The orientation of each tool portion 36, 38 can be determined from the data supplied.

Figure 9:
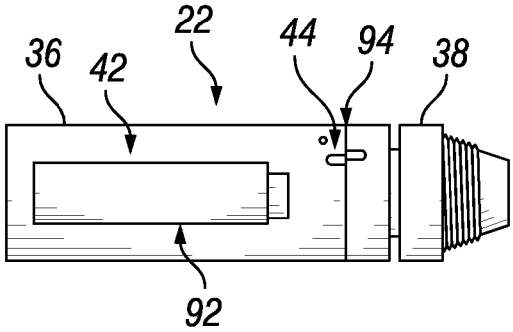
FIG. 9 is a schematic representation of another orientation system able to measure the rotational position of a plurality of components in the downhole equipment, according to an alternate embodiment of the present invention.
Figure 10:
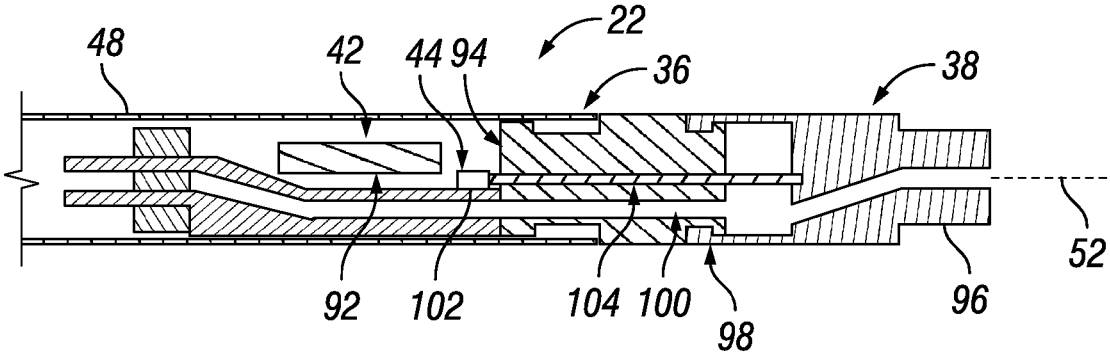
FIG. 10 is a schematic representation of another orientation system able to measure the rotational position of a plurality of components in the downhole equipment, according to an alternate embodiment of the present invention.
Figure 11:
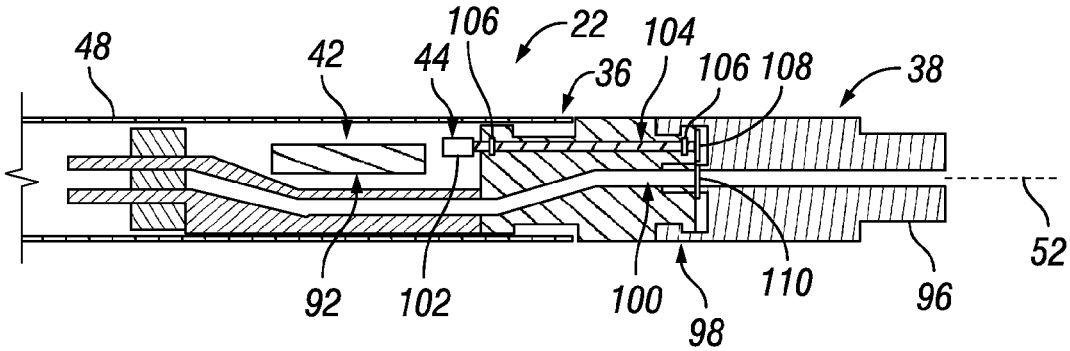
FIG. 11 is a schematic representation of another orientation system able to measure the rotational position of a plurality of components in the downhole equipment, according to an alternate embodiment of the present invention.

Referring generally to FIGS. 9-11, various embodiments of a multi-portion bottom hole assembly 22 are illustrated. In these embodiments, accelerometers and potentiometers are used to determine the angular orientation of first portion 36 and second portion 38. For example, an accelerometer system 92 can be utilized in first portion 36 of bottom hole assembly 22 to determine its orientation. In some embodiments, first portion 36 is fixed to coiled tubing 30 and accelerometer system 92 is used to determine the angular orientation of the fixed portion and the attached coiled tubing with respect to gravity, as illustrated in FIG. 9. A potentiometer system 94 can be used to determine the orientation of second portion 38, e.g. a whipstock, with respect to first portion 36. Either rotational or linear potentiometers can be used to detect the relative rotational movement of second portion 38 with respect to first portion 36.

Referring generally to FIG. 10, a specific example of bottom hole assembly 22 is illustrated in which second portion 38 comprises a tool joint 96 rotationally connected to first portion 36 by a swivel joint 98. A flow port 100 extends longitudinally through first portion 36 and tool joint 96 of bottom hole assembly 22. Potentiometer system 94 comprises a potentiometer 102 coupled to an indicator shaft 104. Potentiometer 102 is mounted in first portion 36, and indicator shaft 104 extends from potentiometer 102 to second portion 38 where it is affixed to the tool joint 96. Thus, rotation of second portion 38 relative to first portion 36 rotates indicator shaft 104, and the relative angular displacement is sensed by potentiometer 102. Accelerometer system 92 is disposed within first portion 36 and can be used to measure angular displacement of first portion 36 from a predetermined orientation, such as a gravitationally determined orientation. In this embodiment, indicator shaft 104 is deployed along the assembly axis 52 of bottom hole assembly 22.

Figure 12:
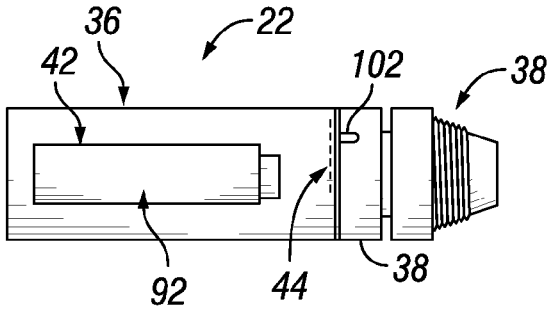
FIG. 12 is a schematic representation of another orientation system able to measure the rotational position of a plurality of components in the downhole equipment, according to an alternate embodiment of the present invention.

Alternatively, potentiometer 102 and indicator shaft 104 can be deployed at a position radially offset from assembly axis 52, as illustrated in FIG. 11. The indicator shaft 104 may be rotatably mounted in bearings 106 and connected to a gear 108. Gear 108 is connected to a corresponding gear 110 mounted about assembly axis 52 to create a one-to-one gear ratio such that indicator shaft 104 is rotated through the same angular displacement as the relative angular displacement between second portion 38 and first portion 36. A variety of arrangements of potentiometers and accelerometers can be constructed to determine relative angular displacements of the bottom hole assembly and/or relative angular displacements between bottom hole assembly portions. For example, the potentiometer 102 can be built into the swivel section, e.g. second portion 38, of the bottom hole assembly with the leads mounted on the fixed portion, e.g. first portion 36, as illustrated in FIG. 12.

Figure 13:
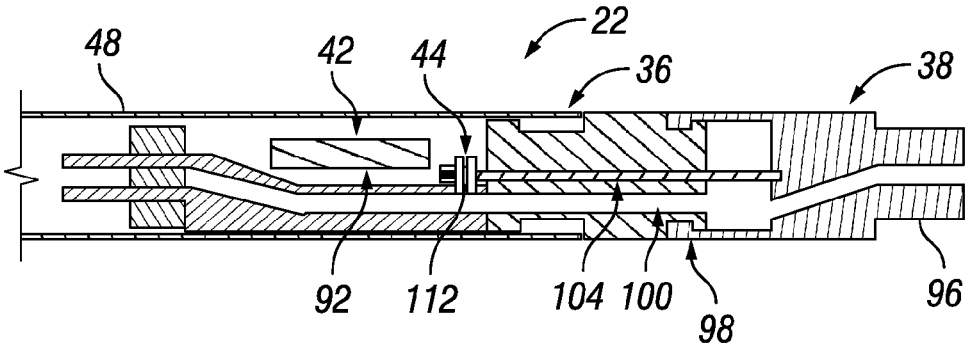
FIG. 13 is a schematic representation of another orientation system able to measure the rotational position of a plurality of components in the downhole equipment, according to an alternate embodiment of the present invention.

In other embodiments, the angular displacement of second portion 38 relative to first portion 36 can be measured with a suitable encoder 112, as illustrated in FIG. 13. Encoder 112 is representative of, for example, an electro-optical encoder or an optical encoder, such as a disc and optical encoder type system. In an optical encoder system, an optic lens can be mounted on first portion 36 of bottom hole assembly 22 and the corresponding disk can be mounted to rotate with second portion 38.

The overall orientation system may be combined with a variety of well equipment for improved detection and control over angular displacement in deviated well environments and other well environments. For example, individual orientation systems can be used to determine the angular displacement of a bottom hole assembly or a bottom hole assembly component relative to a fixed orientation that may be established by gravity. However, one or more additional orientation systems can be added to measure the angular displacement of additional wells system components relative to a fixed orientation or relative to other related components. Furthermore, the configurations of the orientation systems and the components utilized in the orientation systems can vary from one well application to another and from one equipment type to another.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for use in a well, comprising:

a bottom hole assembly having an assembly axis;

an orientation device pivotably mounted in the bottom hole assembly on a device axis offset from the assembly axis, the orientation device being eccentrically weighted to maintain a rotational position when the bottom hole assembly is angularly displaced; and a sensor mounted substantially at the assembly axis adjacent said orientation device for cooperation therewith, the sensor sensing the relative angular displacement between the bottom hole assembly and the orientation device.

2. The system as recited in claim 1, wherein the sensor comprises a fiber optic sensor, and the orientation device comprises a shaded disk.

3. The system as recited in claim 1, wherein the sensor comprises a fiber optic sensor, and the orientation device comprises a light polarizing disk.

4. The system as recited in claim 1, wherein the sensor comprises a fiber optic sensor, and the orientation device comprises a transparent disk prism.

5. The system as recited in claim 1, wherein the sensor comprises a fiber optic sensor, and the orientation device comprises a magnetic flux sensitive polarizing crystal within an eccentrically weighted ring magnet rotationally mounted around the magnetic flux sensitive polarizing crystal.

6. The system as recited in claim 1, wherein the sensor comprises a hall effect sensor; and the orientation device comprises a magnetic member.

7. The system as recited in claim 1, wherein the bottom hole assembly comprises a first portion and a second portion that rotates relative to the first portion.

8. The system as recited in claim 7, further comprising a second sensor, wherein the sensor is positioned to detect the angular displacement of the first portion and the second sensor is positioned to detect the rotation of the second portion relative to the first portion.

9. A method of orienting an assembly in a well, comprising:

mounting an orientation device within a bottom hole assembly for pivotable motion about a device axis;

locating the device axis at a position offset from a central axis of the bottom hole assembly;

eccentrically weighting the orientation device to maintain a rotational position as the bottom hole assembly is angularly displaced; and sensing the rotation of the bottom hole assembly relative to the orientation device with a sensor adjacent thereto.

10. The method as recited in claim 9, further comprising conveying the bottom hole assembly into a deviated wellbore.

11. The method as recited in claim 9, further comprising constructing the bottom hole assembly with a first portion and a second portion able to rotate relative to the first portion.

12. The method as recited in claim 11, wherein mounting comprises mounting the orientation device in the first portion.

13. The method as recited in claim 11, further comprising measuring the position of the second portion relative to the first portion.

14. The method as recited in claim 9, wherein sensing comprises utilizing an optical fiber sensor deployed generally along the axis of the bottom hole assembly proximate the orientation device; and wherein mounting comprises mounting the orientation device so as to rotate through the axis of the bottom hole assembly.

15. A method, comprising:

constructing a bottom hole assembly with a first portion and a second portion rotatable about an assembly axis with respect to the first portion;

mounting a rotational orientation device in at least one of the first portion and the second portion for rotational motion about an offset axis generally parallel with the assembly axis;

eccentrically weighting the rotational orientation device to maintain a rotational position when the bottom hole assembly is deployed in a deviated wellbore; and measuring a change in rotational position of the at least one first portion and second portion relative to the rotational position of the rotational orientation device with a sensor adjacent thereto.

16. The method as recited in claim 15, wherein mounting comprises mounting a disk having variable shading.

17. The method as recited in claim 15, wherein mounting comprises mounting a light polarizing disk.

18. The method as recited in claim 15, wherein mounting comprises mounting a transparent disk prism.

19. The method as recited in claim 15, wherein mounting comprises mounting a magnetic disk.

20. The method as recited in claim 15, wherein mounting comprises mounting an accelerometer.

21. The method as recited in claim 15, wherein the sensor is a fiber optic sensor located generally at the assembly axis and directed toward the rotational orientation device.

* * * * *